US005381564A

United States Patent [19]

Carroll

[11] Patent Number: 5,381,564

[45] Date of Patent: Jan. 17, 1995

[54] BATH AND SHOWER SPLASH GUARD

[76] Inventor: Gerard M. Carroll, 231 Gates Mill Dr., Lawrenceville, Ga. 30245

[21] Appl. No.: 212,033

[22] Filed: Mar. 11, 1994

[51] Int. Cl.[6] ..... A47K 3/00

[52] U.S. Cl. ..... 4/559

[58] Field of Search ..... 4/559, 580, 581, 582, 4/609

[56] References Cited

U.S. PATENT DOCUMENTS

| | | | |
|---|---|---|---|
| 1,791,696 | 2/1931 | Alexander | 4/173 C |
| 2,140,902 | 12/1938 | Fischer | 4/581 |
| 2,534,793 | 12/1950 | Olson | 4/187 |
| 3,444,564 | 5/1969 | Lavacchia | 4/559 |
| 4,025,970 | 5/1977 | Robust | 4/173 R |
| 4,620,332 | 11/1986 | Laird | 4/559 |
| 4,878,257 | 11/1989 | Hardin | 4/658 |
| 5,313,675 | 5/1994 | Tinen | 4/580 |

FOREIGN PATENT DOCUMENTS

| | | | |
|---|---|---|---|
| 0600713 | 7/1934 | Germany | 4/580 |

*Primary Examiner*—Charles F. Phillips

*Attorney, Agent, or Firm*—Kenneth S. Watkins, Jr.

[57] ABSTRACT

A bath tub or shower splash guard is disclosed which can store articles used in bathing. The device comprises a flexible, high friction mat which is draped over the wall of the tub or shower. A collection pan for collecting drainage is attached to the top surface of the mat. The collection pan can be used to store bathing articles. The device can be easily removed and rolled for storage.

6 Claims, 2 Drawing Sheets

BATH AND SHOWER SPLASH GUARD

BACKGROUND

The present invention relates to splash guards for bath tubs and showers, and more particularly, one that can be quickly and easily placed and removed from the tub or shower.

Almost everyone faces the constant problem of preventing splashing and spilling water from a bathroom tub or shower. Water that splashes or drips from the tub or shower ends up on the floor, resulting in a safety problem due to slippery floors, as well as possible damage to floors, structure, and ceilings below due to accumulated water.

Parents are familiar with the problem of keeping the floor reasonably dry while bathing small children. A child's bath has become a period of recreation with toys and games, all of which make splashing of water all the more likely. Many modern homes have carpeted floors that are especially difficult to dry and can result in expensive damage to the flooring or structure.

A number of devices have been disclosed in the past to address this problem. Some of the these devices comprise splash guards which are attached to the wall or walls of the tub or shower to reduce the chance of water splashing on the floor. Another device as disclosed by Laird in U.S. Pat. No. 4,620,332 is a splash collector comprising a gutter fixed to the side of the tub and draining into a separate collector cup. These and other devices suffer drawbacks including inability to easily remove and replace the device and lack of a method to conveniently store the device. A splash guard is also needed which can be used to store and dispense articles used during bathing such as shampoo and hair conditioner containers, washing utensils, and toys.

Therefore, one objective of the present invention is to provide a device which collects splashing water and drainage from a bathroom tub or shower and which can easily be removed and replaced.

A further object of the present invention to provide a device which has a positive method of attachment to the tub or shower.

Yet another object of the present invention to provide a device which has a storage compartment for holding articles used with bathing.

Yet a further object of the present invention to provide a device which can be quickly and conveniently stored when not in use.

SUMMARY

My invention is a splash protector for a bathroom tub or shower which addresses the shortcomings of previous designs. It comprises a rubber or plastic mat which is laid over the top edge of a wall of the tub or shower. The mat is made of a flexible material and has a coefficient of friction with the smooth surface of the tub or shower wall high enough to prevent the mat from slipping off the tub wall. An elongated collection pan with a top opening is attached to the top surface of the mat to collect spillage or drainage running down the mat. In use, the mat is positioned with the top opening of the pan on the outside surface of and below the top edge of the tub wall. The mat has edge dams on its sides to contain any water collected by the mat and prevent it from flowing laterally and escaping the mat. Articles such as shampoo containers and children's toys may be stored in the collection pan for ease of use. The device can be quickly removed and rolled for convenient storage.

Alternative embodiments of the splash guard have grooves running parallel to the front edge of the mat to improve flexibility of the mat. The mat may also comprise additional or alternate attaching means such as suction cups to attach the mat to the tub or shower wall.

My invention addressees the need for a tub or shower splash guard which is quickly and easily installed and removed. It can be used to store articles used during bathing and can be quickly and easily stored.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
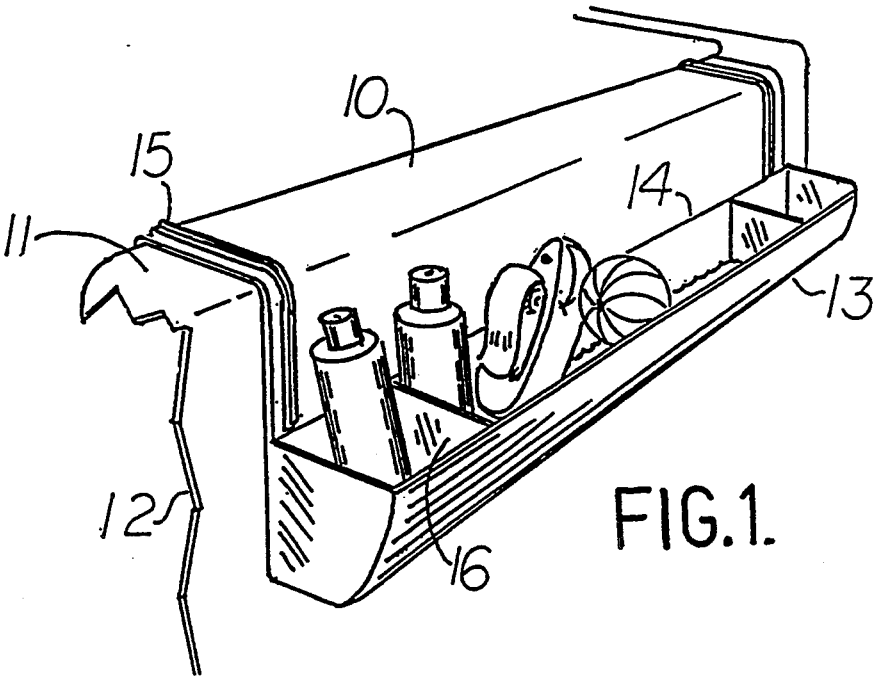
FIG. 1 is a perspective drawing of the preferred embodiment of the present invention installed on a bath tub wall.

The following description discloses a bath tub gutter and splash guard which collects water splashing and drainage from a tub or shower which might otherwise drip or splash on the floor. FIG. 1 shows the bath tub splash guard installed on a wall of a typical bath tub. Elongated mat 10 is draped over the top edge 11 of the tub wall 12. Elongated collection pan 13 is connected to the top surface (41 of FIG. 4) of mat 10 adjacent to front edge 14 and collects drainage from the mat. In addition, collection pan 13 can be used to store various containers and articles such as shampoo bottles and toys. The pan will also collect some direct splashing from the tub or shower. Means for directing water in the form dams 15 prevent drainage from the mat from flowing laterally across the mat and onto the tub wall.

Figure 2:
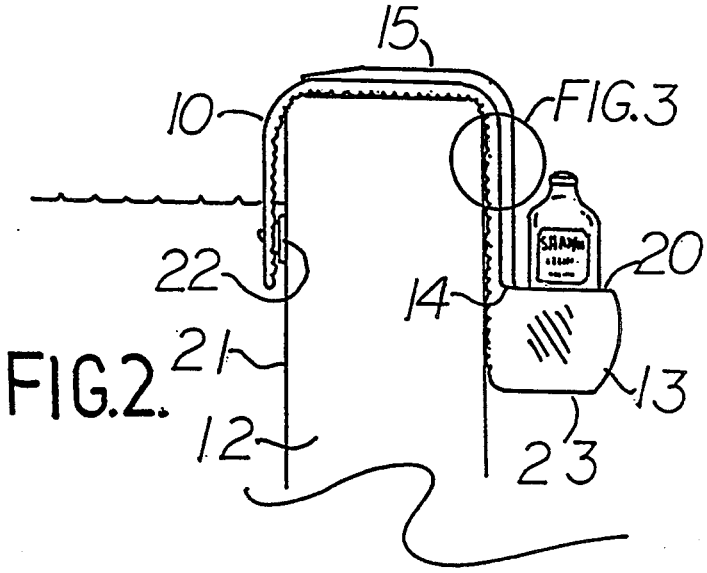
FIG. 2 is an end view of an alternative embodiment of the present invention.

FIG. 2 is and end view of the present invention showing mat 10 draped over the top of tub wall 12. Collection pan 13 is attached to mat 10 so that when the mat is draped over tub wall 12 with the top opening 20 of collection pan 13 below the top edge of the wall, collection pan 13 will collect splashing from the tub and drainage from mat 10. Edge dam 15 constrains drainage and prevents water collected on mat 10 from flowing laterally and spilling on the tub wall or floor.

The device is secured in the position shown in FIG. 2 by an attachment means such as friction between the bottom surface (30 of FIG. 3) of mat 10 and the surface 21 of tub wall 12. Attachment may be made more secure by the use of suction attachment elements or suction cups 22 which will adhere to the surface 21 of wall 12 when pressed against the wall. Suction cups 22 may be formed integrally with mat 10 or made separately and attached to mat 10 by mechanical fasteners or bonding (not shown). Alternatively, suction cups may be attached to collection pan 13.

The collection pan 13 runs the full width of mat 10 in the preferred embodiment. It may have a flat bottom 23 so that it may easily hold containers in an upright position when installed as shown in the figure. Compartment walls (16 of FIG. 1) may be added to facilitate holding articles such as containers.

The material for mat 10 is chosen to be flexible so that it conforms to the shape of the tub wall when installed and so that it may be easily rolled for storage. The material is also chosen to be water repellent and to have a coefficient of friction sufficient to prevent slipping between the mat and the wall, thereby securing the device to the wall. The material should also be durable. Rubber or a plastic material such as a low durometer, highly flexible plastic are suitable for this purpose. Collection pan 13, edge dam 15 and suction cups 22 may be of the same material and formed integrally with mat 10 in a manufacturing process such as molding. Alternatively, the mat may be made of a flexible, water repellent material with a second material, with the required coefficient of friction, bonded or otherwise attached to the bottom surface of the mat.

Figure 3:
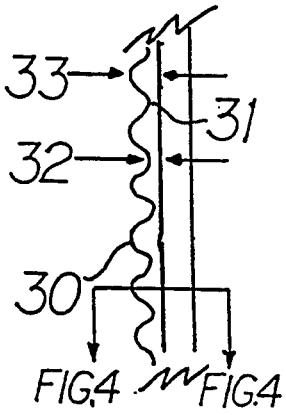
FIG. 3 is a detail of the mat edge of FIG. 2.

FIG. 3 is an edge detail of mat 10. Grooves 31 are parallel to the front edge of mat 10 and on the bottom surface of the mat. The grooves 31 increase the flexibility of mat 10 and allow it to conform to the shape of wall 12, yet maintain lateral stiffness to prevent mat 10 from "cupping away" from wall 12. Mat thickness will vary from 1/64" to ⅛" at the groove valley 32 and 1/16" to ¼" at the groove crest 33, depending on the material used. In the preferred embodiment, mat thickness at the groove valley 32 is approximately 1/16" and at the groove crest 33 is ⅛"–3/16". In an alternative embodiment, the grooving is on the top side of mat 10. If the material is thin (approximately ⅛" or less) and flexible, no grooving is necessary.

Figure 4:
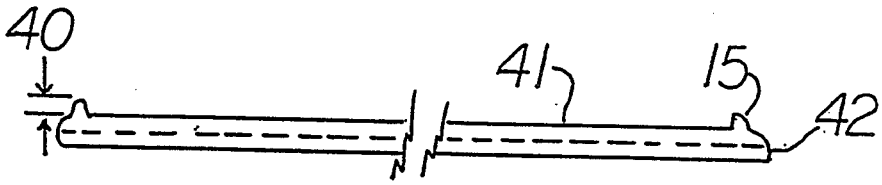
FIG. 4 is a cross section of the mat of FIG. 3.

FIG. 4 is a section of FIG. 3 showing construction of edge dams 15. Edge dams 15 run substantially along side edge 42 and extent above top surface 41 to a sufficient height 40 to constrain drainage and prevent water flow over dam 15. Edge dam height is kept small to minimize the effect on mat 10 flexibility for fitting wall 12 and for rolling for storage. The edge dams form a means for directing water from the top surface of the mat to the top opening of the pan, the means being upstanding from the top surface of the mat and extending from the top opening a distance generally traversing the top edge of the tub, whereby water collected by the mat is prevented from flowing laterally and escaping the mat.

Figure 5:
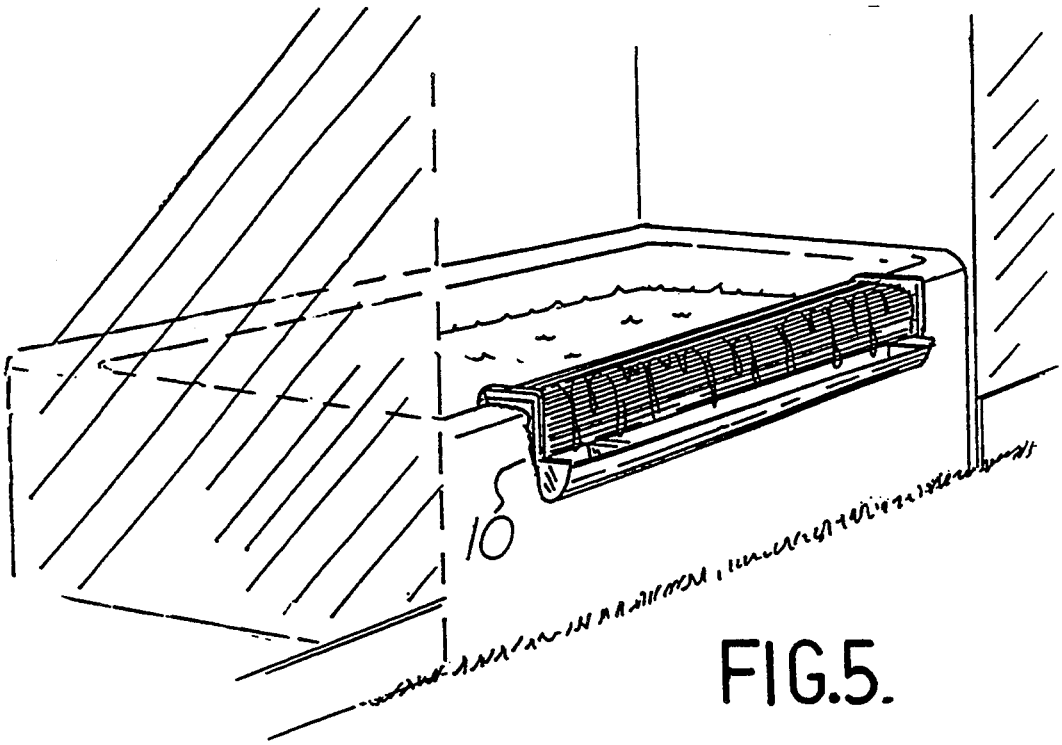
FIG. 5 is perspective drawing of an alternative embodiment of the present invention.

FIG. 5 shows an alternative embodiment with grooving on the outside of mat 10.

Figure 6:
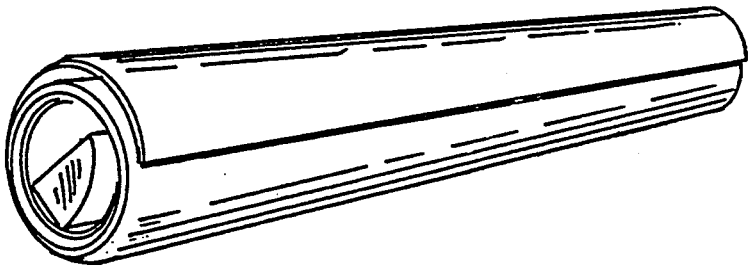
FIG. 6 is a perspective drawing of the present invention rolled for storage.

FIG. 6 shows the gutter guard rolled for storage. The dimensions of the mat can vary depending on the size of the tub or shower for which it will be used. For standard household tubs, the width (distance along the wall) will typically be about 60" and the length 18"–36".

Accordingly the reader will see the that the present invention protects against the spillage or drainage from a tub or shower. The device comprises the following additional advantages:

it is simple and can be manufactured at low cost,
it can be securely fastened to the wall of a tub or shower,
it can be quickly and easily installed and removed,
it can be used for storage of articles, and
it can be rolled for convenient storage.

Although the description above contains many specifications, these should not be construed as limiting the scope of the invention but as merely providing illustrations of some of the presently preferred embodiments of this invention. For example clamps could be used to secure the device to the tub wall, etc.

Thus the scope of the invention should be determined by the appended claims and their legal equivalents, rather than by the examples given.

I claim:

1. A splash guard for collecting water spillage from a tub having a wall with an inside surface, an outside surface and a top edge, the device comprising:

(a) a flexible elongated mat having a top surface and a bottom surface;

(b) an elongated collection pan having a top opening the pan being attached to the top surface of the mat so that when the bottom surface of the mat is laid over the top edge of the wall, the top opening will be below the top edge of the tub wall on the outside surface such that the pan will collect splashing from the tub and drainage from the mat;

(c) means for directing water from the top surface to the top opening, the means being upstanding from the top surface and extending from the top opening a distance generally traversing the top edge, whereby water collected by the mat is prevented from flowing laterally and escaping the mat;

(d) an attachment means for attaching the device to the wall.

2. A device as in claim 1 wherein the attachment means comprises a material on the bottom surface of the mat having a coefficient of friction with the wall sufficiently high to secure the mat to the wall.

3. A device as in claim 1 wherein the attaching means comprises at least one suction attachment element attached to the device.

4. A device as in claim 1 wherein the mat additionally comprises a plurality of grooves parallel to a front edge to improve flexibility, whereby the mat conforms generally to the shape of the wall and allows rolling of the mat for storage.

5. A device as in claim 1 wherein a bottom of the collection pan is flat, whereby the pan can receive and hold a container in an upright position.

6. A device as in claim 1 wherein the collection pan comprises at least one compartment wall for providing a storage compartment within the pan.

* * * * *